US005885002A

United States Patent [19]

Reiss

[11] Patent Number: 5,885,002

[45] Date of Patent: Mar. 23, 1999

[54] RECYCLING APPARATUS AND SYSTEM

[76] Inventor: Jean K. Reiss, 1527 21st, Manhattan Beach, Calif. 90266

[21] Appl. No.: 963,466

[22] Filed: Nov. 3, 1997

[51] Int. Cl.[6] ..... B65D 30/00

[52] U.S. Cl. ..... 383/37; 248/99; 248/100; 220/9.4; 220/495.09; 220/908.1; 383/33

[58] Field of Search ..... 383/37, 33; 248/99, 248/100; 220/9.4, 495.06, 495.08, 495.09, 495.1, 908.1, 909

[56] References Cited

U.S. PATENT DOCUMENTS

| | | | |
|---|---|---|---|
| 217,936 | 7/1879 | Geiser | 248/99 |
| 5,062,540 | 11/1991 | Jenkins | 220/909 X |
| 5,085,342 | 2/1992 | Strawder | 220/495.09 |
| 5,127,538 | 7/1992 | Bach | 220/909 X |
| 5,183,228 | 2/1993 | Curry | 248/100 |
| 5,188,254 | 2/1993 | Evans | 220/909 X |
| 5,190,252 | 3/1993 | Schrager | 220/909 X |

*Primary Examiner*—Jes F. Pascua

[57] ABSTRACT

A recycling apparatus and system for plastic material and electronics parts. The completely assembled unit encompasses a support frame and a plurality of color coded transparent collection bags. The color scheme represents electronic resistors which coincide with the number codes of the Society of Plastic Industry. The recycling apparatus including an octagonal base member that has a base top and a base bottom. Included is a center post. The center post projects from the base top and has a lower end and an upper end. The upper end has a pair of upper diametric openings that extend through the pole. The upper end has a pair of lower diametric openings that extend through the pole. Four elongated dowel members are provided. Each dowel has three threaded recesses. A first dowel of the four dowels is positioned through one of the pair of upper diametric openings. A second dowel of the four dowels is positioned through another of the pair of upper diametric openings. A third dowel of the four dowels being positioned through one of the pair of lower diametric openings. A fourth dowel of the four dowels being positioned through another of the pair of lower diametric openings. At least 12 knobs are included and each knob is threaded. Each knob is capable of threadable coupling with atleast one of the recesses of the four dowels. Finally, a plurality of color coded transparent plastic bag members are positioned on any three of the 12 knobs to hang vertically from at least two of the four dowels.

9 Claims, 4 Drawing Sheets

66

10
60
2
72
1
2
3
4
5
6
7
8
76

66
56

74
60
28
22
72
74

FIG 5
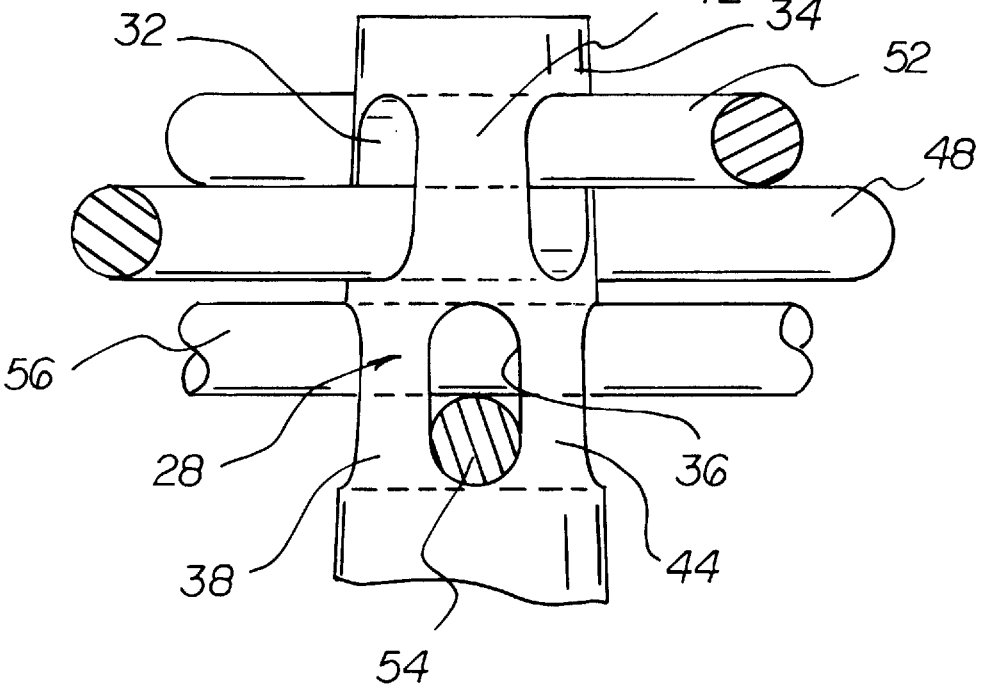
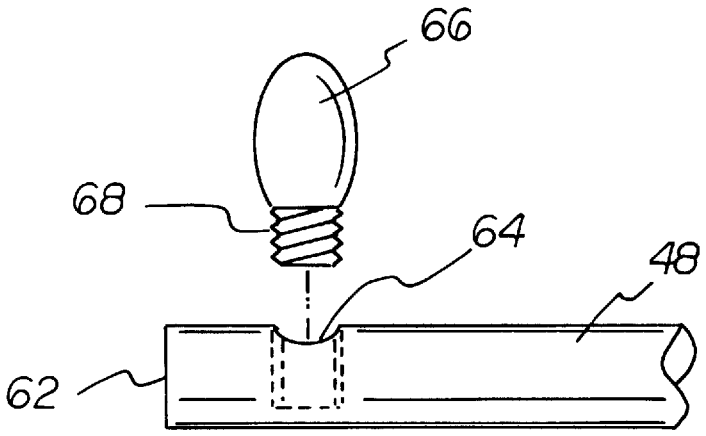
FIG 6

RECYCLING APPARATUS AND SYSTEM

BACKGROUND OF THE INVENTION

1. Field of the Invention

The present invention relates to a recycling apparatus and system and more particularly pertains to providing an apparatus for containment of discarded plastics and electronic material and a means to organize the discarded materials with the use of color coded transparent plastic bags.

2. Description of the Prior Art

The use of a recycling container is known in the prior art. More specifically, recycling containers heretofore devised and utilized for the purpose of separating waste material are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,101,984 to Shaw discloses a recycling trash bag arrangement wherein a series of individual plastic bags are suspended from a rack structure and marked to receive a particular kind of recyclable material. Each of the bags is marked with an identifying name of the recyclable material to be placed therein.

U.S. Pat. No. 5,131,499 to Hoar discloses a retail store check-out device that has a generally carousel structure. The device has a compartment that is configured to receive a plastic bag which is held open by hooks so as to receive materials of various sizes and shapes.

U.S. Pat. No. 5,190,183 to McNaughton, et al. discloses a trash can divider which is used to support plastic liner bags to receive a variety of materials such as trash and recyclables. The trash can divider is made with telescopic arms and end clips so that the device may be installed in a conventional cylindrical type trash can.

U.S. Pat. No. 5,190,252 to Schrager discloses a refuse bag support system that is used to sort and store various kinds of materials.

U.S. Pat. No. 5,183,228 to Curry discloses a device for compartmentalizing a container into a plurality of individual compartments.

U.S. Pat. No. 5,072,883 to Hansen et al. discloses a method of collecting recyclable materials and separating recycled materials from household and commercial refuse for recycling at a recyclable material recovery facility.

Lastly, U.S. Pat. No. 5,018,876 to Mennella discloses a divided separable trash bag that is made of recyclable plastic.

In this respect, the recycling apparatus and system according to the present invention substantially departs from the conventional concepts and designs of the prior art, and in so doing provides an apparatus primarily developed for the purpose of providing an apparatus for containment of discarded plastics and electronic material and a means to organize the discarded material.

Therefore, it can be appreciated that there exists a continuing need for a new and improved recycling apparatus and system which can be used for providing an apparatus for containment of discarded plastics and electronic material and a means to organize the discarded material. In this regard, the present invention substantially fulfills this need.

SUMMARY OF THE INVENTION

The Society of the Plastic Industry (SPI) has developed a system to identify the types of plastic resins used in plastic containers (Refer to the attached SPI code sheet). The majority of plastic bags or containers currently on the market already have the number code imprint on them.

Using a similar color code system such as the Universal Electronic Resistor Color Code to match each of the SPI number code. The colors used for the plastic waste bags should be light in color, transparent and manufactured from the same plastic material they are intended to collect. Example:

brown for SPI code 1 (PETE); polyethlene terephthalate
red for SPI code 2 (HDPE); high-density polyethlene
orange for SPI code 3 (V); vinyl
yellow for SPI code 4 (LDPE); low-density polyethlene
green for SPI code 5 (PP); polypropylene
blue for SPI code 6 (PS); polystyrene
violet for SPI code 7 (other), and gray for electronics parts.

Material: Plastic waste bags should be made from the same materials for which they are intended. Example: Manufacture waste collection bag using LDPE (low-density polyethlene) in clear light yellow with SPI code 4 imprint recycling symbol. Transparency: The collection bag should be clear with no color to interfere with the graphic imprint on it. It allows a clear view of its contents.

Size: The most common 15 gallon size plastic bags as those are currently in use, but various other sized of waste bags (such as the outdoor 30 gallons for garden leaf wastes) could be available for different occasions. When full each water bag contains the same group of material, each bag is treated as a separate unit. No further sorting is necessary. Due to the transparency which makes it easy to observe the contents and increase the recyclability.

The advantages or improvements over existing practices: the existing recycling practices for plastics are not sorted separately. The waste management company needs to resort them. The electronics parts are thrown away in regular trash which occupies landfill space. The advantages for the suggested method should be: a) People in the electronic or plastic industry are already familiar with the color code. It's easy to associate the color code and increase the recycling efficiency; b) possibility of opportunity in recycling the electronic parts; c) time saving from the waste management point of view; reduce waste bulk, and preserve the environment.

In view of the foregoing disadvantages inherent in the known types of recycling containers now present in the prior art, the present invention provides an improved recycling apparatus and system. As such, the general purpose of the present invention, which will be described subsequently in greater detail, is to provide a new and improved recycling apparatus and system which has all the advantages of the prior art and none of the disadvantages.

To attain this, the present invention essentially comprises a generally octagonal base member. The base member has a base top and a base bottom. Included is a generally cylindrical center post. The center post is integral with the base top and projecting vertically therefrom. The center post has a lower end and an upper end. The lower end has a diameter of about 2 inches for disallowing a swaying movement of the center post. The upper end has a diameter of about 1 inch. The upper end has a pair of upper diametric openings extending through the pole and equally spaced around the periphery at a top of the upper end. The upper end has a pair of lower diametric openings extending through the pole, and equally spaced around the periphery at a bottom of the upper end. The lower diametric openings are rotationally offset from the upper diametric openings.

Four elongated dowel members are provided. Each dowel member has a diameter of about ¾ inches and a length of about 2 feet. Each dowel has a first end and a second end. Each dowel has three threaded recesses. The threaded recesses of each dowel form a first recess spaced from the end, a second recess spaced from the second end and a third recess. The third recess of each of the four dowels is spaced between the first and second recess of the four dowels. Also, a first dowel of the four dowels is positioned through one of the pair of upper diametric openings and extends radially from the center post. A second dowel of the four dowels is positioned through another of the pair of upper diametric openings and extends radially from the center post. A third dowel of the four dowels is positioned through one of the pair of lower diametric openings and extends radially from the center post. A fourth dowel of the four dowels is positioned through another of the pair of lower diametric openings and extends radially from the center post.

Additionally, at least 12 knobs are included. Each knob has a cylindrical extent projecting therefrom. Each extent of each knob is threaded and capable of threadable coupling with at least one of the recesses of the four dowels. Lastly, a plurality of triangular bag members are provided. Each bag member is formed of a flexible material and has three punched holes as corner loops. Each of the three corner loops of each bag member engages one of the knobs coupled to one of the recesses of one of the four dowels. Coupling the corner loops to knobs will allow each of the plurality of bag members to hang vertically from at least two of the four dowels.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved recycling apparatus and system which has all the advantages of the prior art recycling containers and none of the disadvantages.

It is another object of the present invention to provide a new and improved recycling apparatus and system which may be easily and efficiently manufactured and marketed.

It is a further object of the present invention to provide a new and improved recycling apparatus and system which is of a durable and reliable construction.

An even further object of the present invention is to provide a new and improved recycling apparatus and system which is susceptible of a low cost of manufacture with regard to both materials and labor, and which accordingly is then susceptible of low prices of sale to the consuming public, thereby making such recycling apparatus and system economically available to the buying public.

Still yet another object of the present invention is to provide a new and improved recycling apparatus and system which provides in the apparatuses and methods of the prior art some of the advantages thereof, while simultaneously overcoming some of the disadvantages normally associated therewith.

Still another object of the present invention is to providing an apparatus for containment of discarded plastics and electronic material and a means to organize the discarded material.

Lastly, it is an object of the present invention to provide a new and improved octagonal base member that has a base top and a base bottom. Included is a center post. The center post projects from the base top and has a lower end and an upper end. The upper end has a pair of upper diametric openings that extend through the pole. The upper end has a pair of lower diametric openings that extend through the pole. Four elongated dowel members are provided. Each dowel has three threaded recesses. A first dowel of the four dowels is positioned through one of the pair of upper diametric openings. A second dowel of the four dowels is positioned through another of the pair of upper diametric openings. A third dowel of the four dowels being positioned through one of the pair of lower diametric openings. A fourth dowel of the four dowels being positioned through another of the pair of lower diametric openings. At least 12 knobs are included and each knob is threaded. Each knob is capable of threadable coupling with atleast one of the recesses of the four dowels. Finally, a plurality of triangular bag members are positioned on any three of the 12 knobs to hang vertically from at least two of the four dowels.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an enlarged cut-away view of the upper end of the center post of the present invention FIG. 6 is an exploded view of the knob and dowel of the present invention.

Similar reference characters refer to similar parts throughout the several views of the drawings.

DESCRIPTION OF THE PREFERRED EMBODIMENT

Figure 1:
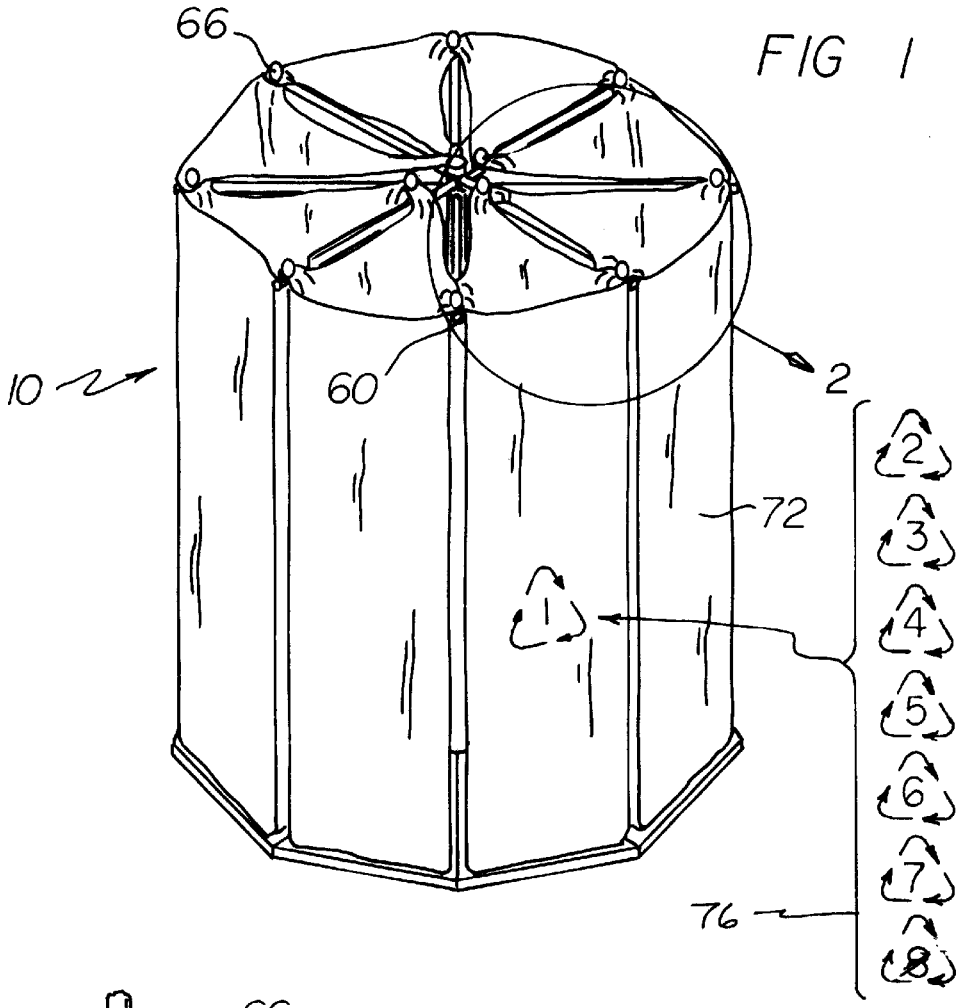
FIG. 1 is a perspective illustration of the preferred embodiment of the recycling apparatus and system constructed in accordance with the principles of the present invention.

With reference now to the drawings, and in particular to FIG. 1 thereof, a new and improved recycling apparatus and system embodying the principles and concepts of the present invention and generally designated by the reference numeral 10 will be described.

The present invention, the new and improved recycling apparatus and system, is comprised of a plurality of components. Such components in their broadest context include a base, a post, dowels and plastic bags. Such components are individually configured and correlated with respect to each other so as to attain the desired objective.

Figure 4:
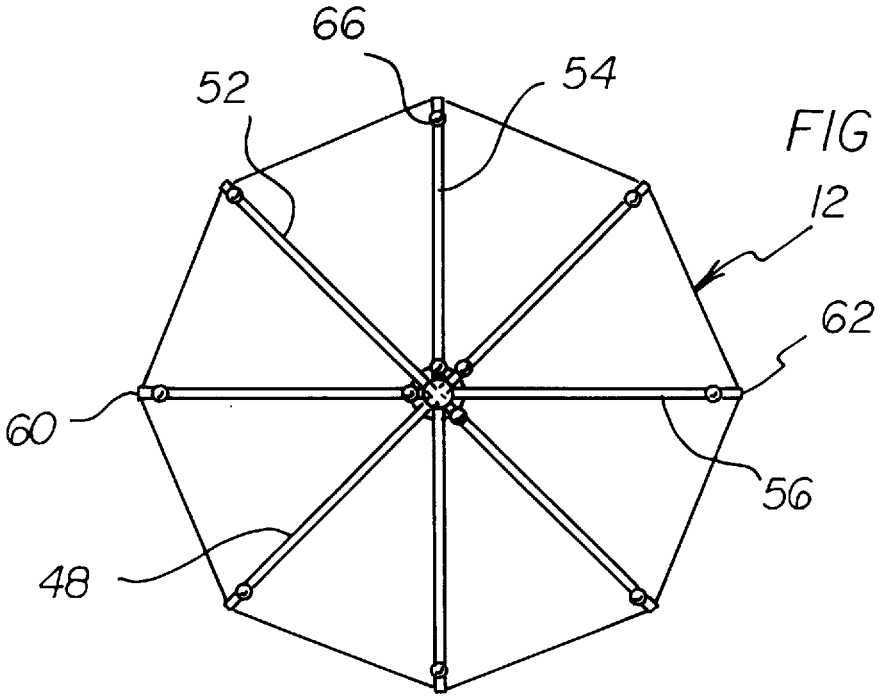
FIG. 4 is a top view of the present invention taken along line 4—4 of FIG. 3.

More specifically, the present invention includes a generally octagonal base member 12, as shown in FIG. 4. The base member may be formed of wood, plastic or metal. Preferably the base is formed of plastic. The base member has a base top 14 and a base bottom 16. The base has a peripheral edge 18 therearound. The base member has a thickness of 1½ inches at its center and a thickness of ¾ inches at the peripheral edge.

Figure 3:
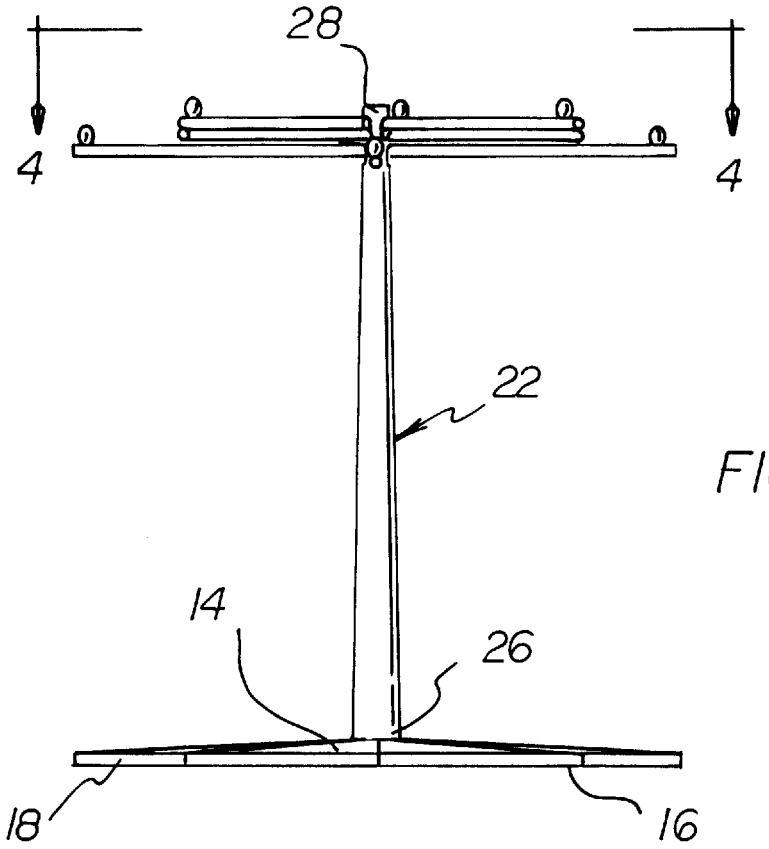
FIG. 3 is side view of the present invention minus the plastic bag members.

As best illustrated in FIG. 3, included is a generally cylindrical center post 22. The center post is made of wood, plastic or metal. Preferably the center post is plastic. The center post may be releasably coupled with the base top or integral the base top. Preferably, the center post is releasably coupled with the base top and projects vertically upward from the center of the base top. Releasable coupling of the center post to the base member allows for ease of disassembly for storage or transporting. The center post has a lower end 26 and an upper end 28. The lower end has a diameter of about 2 inches for disallowing a swaying movement of the center post. The upper end has a diameter of about 1 inch. The upper end has a pair of upper diametric openings 32. The pair of upper diametric openings each extend through the pole, as seen in FIG. 5, and are equally spaced around the periphery near a top 34 of the upper end. The upper end has a pair of lower diametric openings 36. The pair of lower diametric openings extend through the pole, and equally spaced around the periphery near a bottom 38 of the upper end. The lower diametric openings are rotationally offset from the upper diametric openings. In between the upper diametric openings are a first set four rotational spaces 42. In between the lower diametric openings area second set of four rotational spaces 44. The second set of rotational spaces are offset from the first set of rotational spaces.

Also, four elongated dowel members 48, 52, 54 and 56, are provided. Each dowel member has a diameter of about ¾ inches and a length of about 2 feet. Each dowel has a first end 60 and a second end 62. Each dowel has three threaded recesses with each recess structured like the recess 64 of FIG. 6. The threaded recesses of each dowel form a first recess spaced from first the end 60, a second recess spaced from the second end and a third recess. The third recess of each of the four dowels is spaced between the first and second recess of the four dowels.

Additionally, a first dowel 48 of the four dowels is positioned through one of the pair of upper diametric openings and extends radially from the center post. A second dowel 52 of the four dowels is positioned through another of the pair of upper diametric openings and extends radially from the center post. The second dowel, when placed through another of the pair of diametric openings, is placed over the first dowel. When the second dowel is placed over the first dowel a ninety degree angle is formed with the first dowel. A third dowel 54 of the four dowels is positioned through one of the pair of lower diametric openings and extends radially from the center post. A fourth dowel 56 of the four dowels is positioned through another of the pair of lower diametric openings and extends radially from the center post. The fourth dowel, when placed through another of the pair of diametric openings, is placed over the third dowel. When the fourth dowel is placed over the third dowel a ninety degree angle is formed with the third dowel. FIG. 4 shows the four dowels as they extend radially from the upper end of the center post 22.

Additionally, at least 12 knobs are included. Each knob 66, as shown in FIG. 6, has a cylindrical extent 68 that projects outwardly. Each extent of each knob is threaded for threadable coupling with at least one of the recesses of the four dowels. As illustrated in FIG. 4, each recess of each dowel has a knob.

Figure 2:
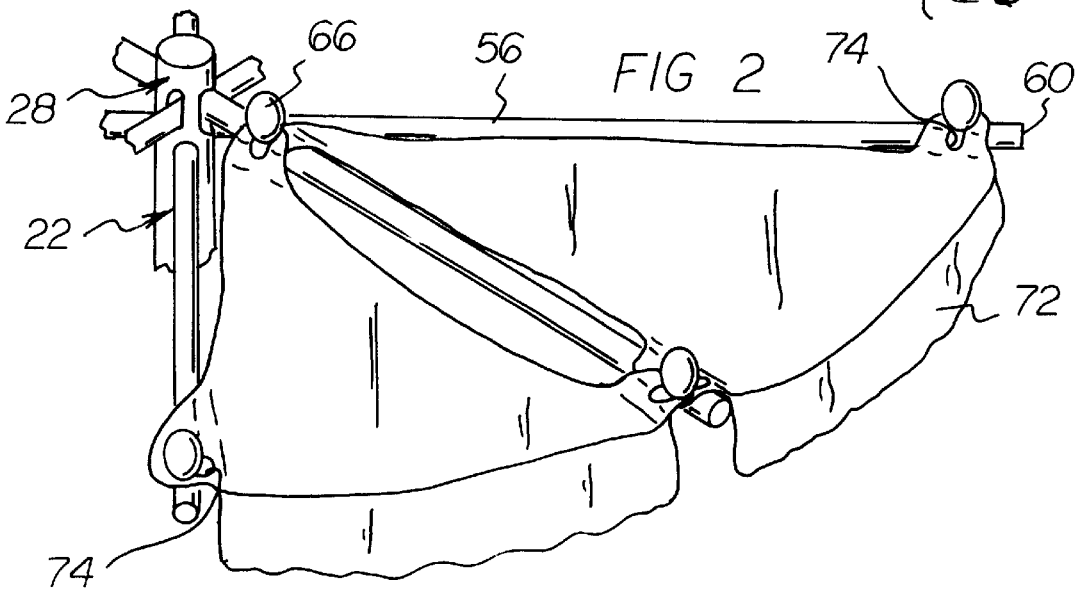
FIG. 2 is a cut-away view taken at position 2 of FIG. 1 of the present invention.

Lastly, a plurality of triangular bag members 72 are provided. Each bag member is formed of a flexible material, preferably a transparent and colored, and has three punched holes as corner loops. Each of the corner loops 74 is depicted in FIG. 2. Each of the three corner loops of each bag member engages one of the knobs coupled to one of the recesses of one of the four dowels. Coupling the corner loops to knobs will allow each of the plurality of bag members to hang vertically from at least two of the four dowels, as seen in FIG. 1.

Furthermore, each plastic bag members has a different color from another of the plastic bag members. Each of the plastic bag members has a Society of Plastics Industry number code that matches the Universal Electronic Resistor color code. Also, each plastic bag member has a transparent color code and has a graphic symbols for indicating the type of waste material to be placed into the plastic bag member. The graphic symbols 76, as seen in FIG. 1, are as follows:

| number | Acronym | Description | color |
|---|---|---|---|
| 1 | PETE | polyethlene terephthalate | brown |
| 2 | HDPE | high-density polyethlene | red |
| 3 | V | vinyl | orange |
| 4 | LDPE | low-density polyethlene | yellow |
| 5 | PP | polypropylene | green |
| 6 | PS | polystyrene | blue |
| 7 | other | | violet |
| 8 | E | electronics parts | gray |

Figure 7:
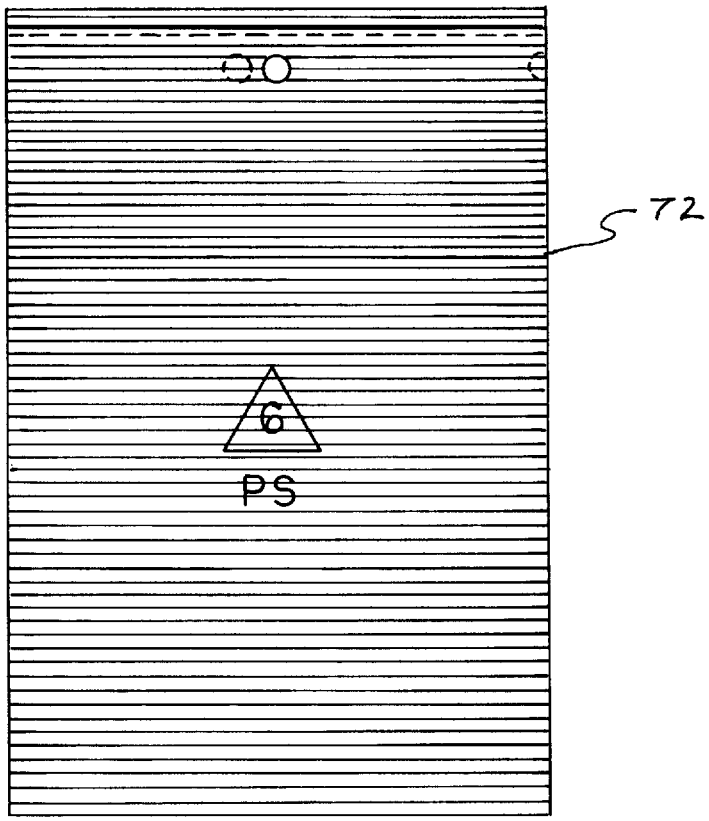
FIG. 7 is a frontal view of a sample for the color coded transparent plastic bag for the system.

FIG. 7, depicts a transparent blue bag member 72 having the graphic symbol 6, to indicate that polystyrene should be placed within the bag.

The present invention recycling apparatus and system is geared toward a better system of recycling plastic packaging materials or electronic parts. A stand in made with a base member, a center post and a plurality of dowels. Each of the dowels has knobs for allowing the plastic bag member to hang from the dowels. The stand supports eight bags. The plastic bag members that are hung from the dowels are color coded and coded with graphic symbols.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved recycling apparatus and system comprising:

an octagonal base member having a base top and a base bottom;

a center post projecting from the base top and having a lower end and an upper end, the upper end having a pair of upper diametric openings extending through the pole, the upper end having a pair of lower diametric openings extending through the pole;

four elongated dowel members with each dowel having three threaded recesses therein;

a first dowel of the four dowels being positioned through one of the pair of upper diametric openings, a second dowel of the four dowels being positioned through another of the pair of upper diametric openings, a third dowel of the four dowels being positioned through one of the pair of lower diametric openings, a fourth dowel of the four dowels being positioned through another of the pair of lower diametric openings;

at least 12 knobs with each knob being threaded and capable of threadable coupling with at least one of the recesses of the four dowels; and a plurality of triangular bag members positioned on any three of the 12 knobs to hang vertically from at least two of the four dowels.

2. The new and improved recycling apparatus and system as set forth in claim 1, wherein the center post being integral with the base top and projecting vertically therefrom.

3. The new and improved recycling apparatus and system as set forth in claim 1, wherein the pair of upper diametric openings being equally spaced around the periphery at a top of the upper end, and the pair of lower diametric openings being equally spaced around the periphery at a bottom of the upper end.

4. The new and improved recycling apparatus and system as set forth in claim 3, wherein the lower diametric openings being rotationally offset from the upper diametric openings.

5. The new and improved recycling apparatus and system as set forth in claim 1, wherein each dowel member having a diameter of about ¾ inches and a length of about 2 feet, each dowel having a first end and a second end.

6. The new and improved recycling apparatus and system as set froth in claim 1, wherein the threaded recesses of each dowel forming a first recess, a second recess and a third recess, the third recess of each of the four dowels being spaced between the first and second recess of the four dowels.

7. The new and improved recycling apparatus and system as set forth in claim 1, wherein the plastic bags being formed of a flexible material and having three corner loops, each of the three corner loops of each bag member engaging one of the knobs coupled to one of the recesses of one of the four dowels.

8. A new and improved recycling apparatus and system for disposal of non-biodegradable waste material comprising:

an octagonal base member having a base top and a base bottom;

a center post being releasably coupled with the base top and projecting vertically therefrom, the center post having a lower end and an upper end, the upper end having a pair of upper diametric openings extending through the pole, the upper end having a pair of lower diametric openings extending through the pole;

four elongated dowel members with each dowel member having a diameter of about ¾ inches and a length of about 2 feet, each dowel having a first end and a second end, each dowel having three threaded recesses therein, the threaded recesses of each dowel forming a first recess spaced from the end, a second recess spaced from the second end and a third recess, the third recess of each of the four dowels being spaced between the first and second recess of the four dowels;

a first dowel of the four dowels being positioned through one of the pair of upper diametric openings, a second dowel of the four dowels being positioned through another of the pair of upper diametric openings, a third dowel of the four dowels being positioned through one of the pair of lower diametric openings, a fourth dowel of the four dowels being positioned through another of the pair of lower diametric openings;

at least 12 knobs with each knob being threaded and capable of threadable coupling with at least one of the recesses of the four dowels; and a plurality of triangular bag members positioned on any three of the 12 knobs to hang vertically from at least two of the four dowels.

9. A new and improved recycling apparatus and system for disposal of non-biodegradable waste material applying the principal that the waste collection bags are made with transparent color coded plastic resin, using the Universal Electronic Resistor Color Code system to match the Society of the Plastic Industry number codes, comprising in combination:

a generally octagonal base member having a base top and a base bottom;

a generally cylindrical center post being integral with the base top and projecting vertically therefrom, the center post having a lower end and an upper end, the lower end having a diameter of about 2 inches for disallowing a swaying movement of the center post, the upper end having a diameter of about 1 inch, the upper end having a pair of upper diametric openings extending through the pole and equally spaced around the periphery at a top of the upper end, the upper end having a pair of lower diametric openings extending through the pole and equally spaced around the periphery at a bottom of the upper end, the lower diametric openings being rotationally offset from the upper diametric openings;

four elongated dowel members with each dowel member having a diameter of about ¾ inches and a length of about 2 feet, each dowel having a first end and a second end, each dowel having three threaded recesses therein, the threaded recesses of each dowel forming a first recess spaced from the first end, a second recess spaced from the second end and a third recess, the third recess of each of the four dowels being spaced between the first and second recess of the four dowels;

a first dowel of the four dowels being positioned through one of the pair of upper diametric openings to extend radially from the center post, a second dowel of the four dowels being positioned through another of the pair of upper diametric openings to extend radially from the center post, a third dowel of the four dowels being positioned through one of the pair of lower diametric openings to extend radially from the center post, a fourth dowel of the four dowels being positioned through another of the pair of lower diametric openings to extend radially from the center post;

at least 12 knobs with each knob having a cylindrical extent projecting therefrom, each extent of each knob being threaded and capable of threadable coupling with at least one of the recesses of the four dowels; and a plurality of triangular bag members formed of a flexible material and having three punched holes as corner loops, each of the three corner loops of each bag member engaging one of the knobs coupled to one of the recesses of one of the four dowels for allowing each of the plurality of bag members to hang vertically from at least two of the four dowels.

* * * * *